US008457820B1

(12) United States Patent
Gonring

(10) Patent No.: US 8,457,820 B1
(45) Date of Patent: Jun. 4, 2013

(54) MARINE VESSEL PORPOISING CONTROL METHOD

(75) Inventor: Steven J. Gonring, Slinger, WI (US)

(73) Assignee: Brunswick Corporation, Lake Forest, IL (US)

( * ) Notice: Subject to any disclaimer, the term of this patent is extended or adjusted under 35 U.S.C. 154(b) by 350 days.

(21) Appl. No.: 12/907,152

(22) Filed: Oct. 19, 2010

(51) Int. Cl.
*B63H 20/08* (2006.01)

(52) U.S. Cl.
USPC ..... 701/21; 440/1

(58) Field of Classification Search
USPC ..... 701/21; 440/1, 53, 61 G, 61 T, 87, 440/84; 114/144 E, 144 R, 144 RE
See application file for complete search history.

(56) References Cited

U.S. PATENT DOCUMENTS

| | | | | |
|---|---|---|---|---|
| 4,398,483 | A | 8/1983 | Wood et al. | |
| 4,708,672 | A | 11/1987 | Bentz et al. | |
| 5,085,603 | A | 2/1992 | Haluzak | |
| 5,142,473 | A * | 8/1992 | Davis | 701/21 |
| 5,263,432 | A | 11/1993 | Davis | |
| 5,507,672 | A | 4/1996 | Imaeda | |
| 5,540,174 | A | 7/1996 | Kishi et al. | |
| 5,683,275 | A | 11/1997 | Nanami | |
| 5,685,253 | A | 11/1997 | Alexander, Jr. | |
| 6,058,873 | A | 5/2000 | Koyanagi | |
| 6,230,642 | B1 | 5/2001 | McKenney et al. | |
| 6,332,422 | B1 | 12/2001 | Laroche | |
| 6,524,146 | B2 | 2/2003 | Spade et al. | |
| 6,604,479 | B2 | 8/2003 | McKenney et al. | |
| 6,997,763 | B2 * | 2/2006 | Kaji | 440/1 |
| 7,143,363 | B1 * | 11/2006 | Gaynor et al. | 715/771 |
| 7,305,928 | B2 | 12/2007 | Bradley et al. | |
| 7,416,456 | B1 * | 8/2008 | Gonring et al. | 440/1 |
| 7,485,021 | B2 * | 2/2009 | Walser et al. | 440/87 |

OTHER PUBLICATIONS

Smart Tabs raise your performance expectations, http://www.nauticusinc.com, 2 pages, website visited Aug. 24, 2010.
Trim Tab Installation by James W. Hebert, http://continuouswave.com/whaler/reference, 17 pages, website visited Aug. 24, 2010.
Using an Accelerometer for Inclination Sensing, Analog Devices, http://search.analog.com/search/ProductSearch, 9 pages, website visited Aug. 24, 2010.
How Insta-Trim Boat Levelers Work, http://insta-trim.com, 9 pages, website visited Aug. 24, 2010.
Fiberglassing the Bottom Trailing Edge of a Power Boat, Boat Builder Newsletter #54, 1 page, http://www.glen-1.com/weblettr, website visited Aug. 24, 2010.
The Science of Levers, Tommy Boone, Ph.D MPH et al., Chapter 51, faculty.css.edu/tboone2/asep/Lever.doc, 16 pages, website visited Aug. 24, 2010.
Porpoising oscillations of very-high-speed marine craft, Y. Ikeda and T. Katayama, The Royal Society, Phil. Trans. R. Soc. Lond. A (2000) 358, pp. 1905-1915.

* cited by examiner

*Primary Examiner* — Dalena Tran
(74) *Attorney, Agent, or Firm* — Andrus, Sceales, Starke & Sawall, LLP

(57) ABSTRACT

A method is provided by controlling the operation of a marine vessel subject to porpoising. The method includes sensing an operational characteristic of the marine vessel which is indicative of porpoising of the marine vessel, and responding to the sensing of the operational characteristic with a response that is representative of the operational characteristic of the marine vessel as being indicative of the porpoising of the marine vessel.

6 Claims, 5 Drawing Sheets

MARINE VESSEL PORPOISING CONTROL METHOD

BACKGROUND AND SUMMARY

The invention relates to marine vessels, and more particularly to porpoising thereof.

Porpoising of marine vessels is known in the prior art. Porpoising is a dynamic instability in which the bow of the boat moves toward and away from the surface of the water. It is not an uncommon problem in various hull designs, and is generally corrected by manually adjusting trim tabs or the drive trim.

The present invention arose during continuing development efforts in the above technology.

DETAILED DESCRIPTION

Figure 1:
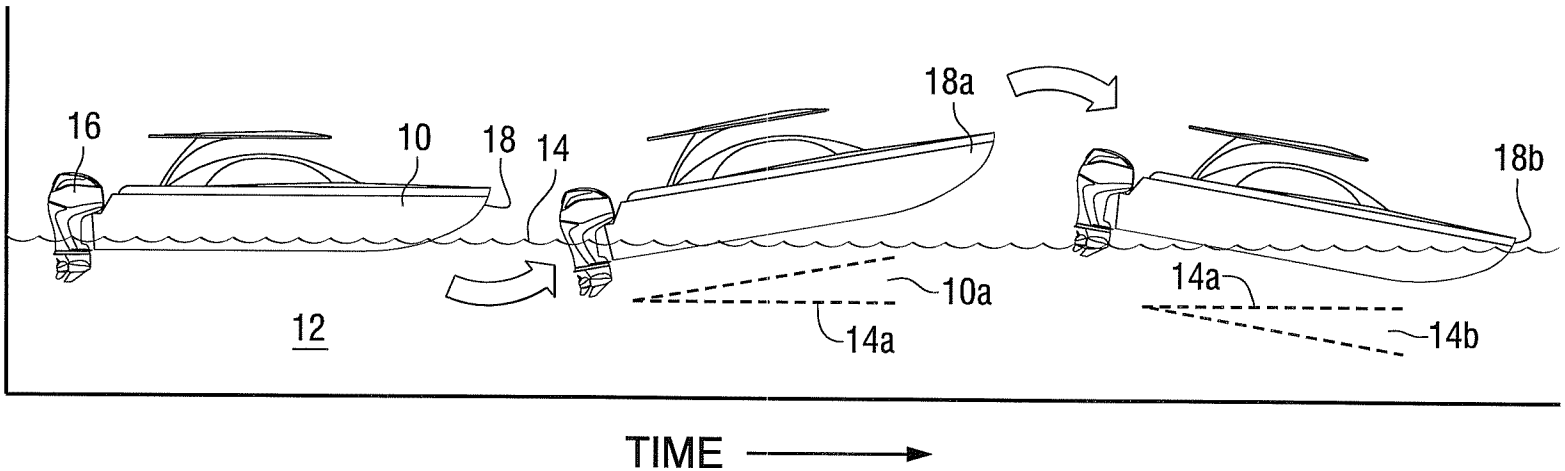
FIG. 1 is a schematic drawing illustrating porpoising of a marine vessel.

FIG. 1 shows a marine vessel 10 in a body of water 12 having a water surface 14. Vessel 10 is propelled by a marine drive 16, for example an outboard motor as shown, or by a sterndrive, or other marine drives as known. Porpoising occurs when the bow 18 of the vessel moves upwardly away from the surface 14 of the water as shown at 18*a*, and then back downwardly toward the surface of the water as shown at 18*b*, in a cyclic pattern, e.g. bobbing up and down.

Figure 2:
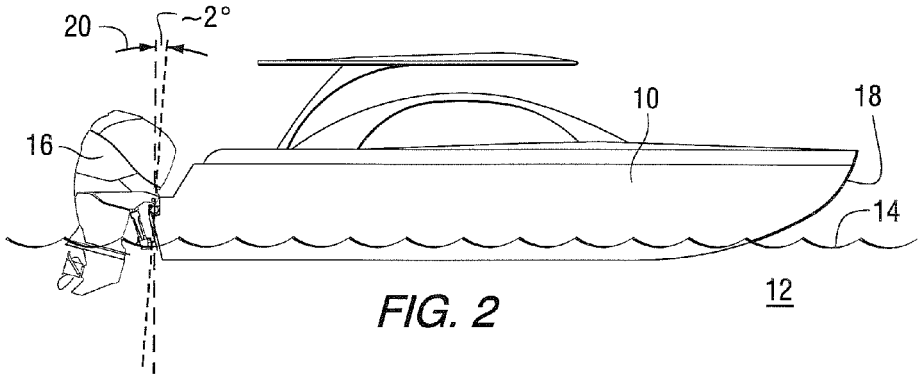
FIG. 2 illustrates drive trim of a marine vessel, more particularly a trimmed-out condition.
Figure 3:
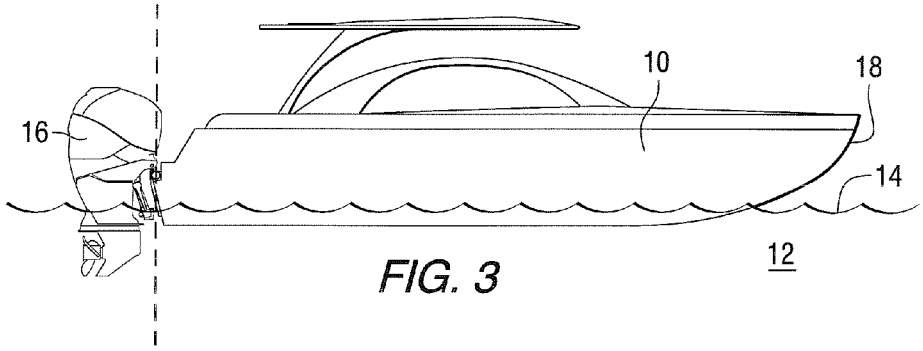
FIG. 3 is like FIG. 2 but shows a zero drive trim angle.
Figure 4:
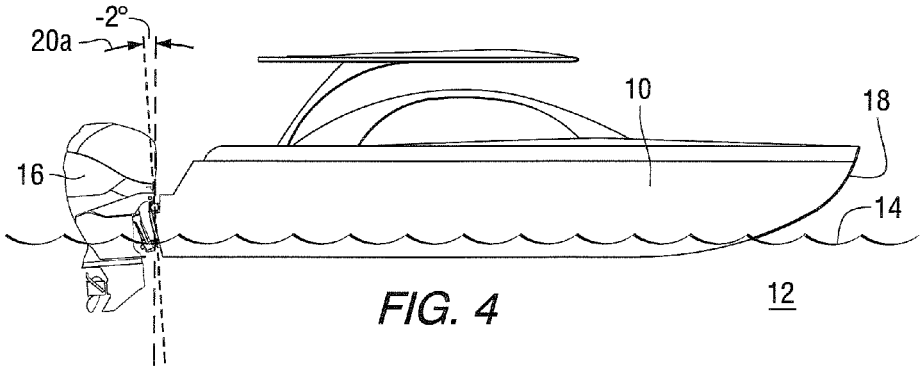
FIG. 4 is like FIG. 2 but shows a trimmed-in condition.
Figure 5:
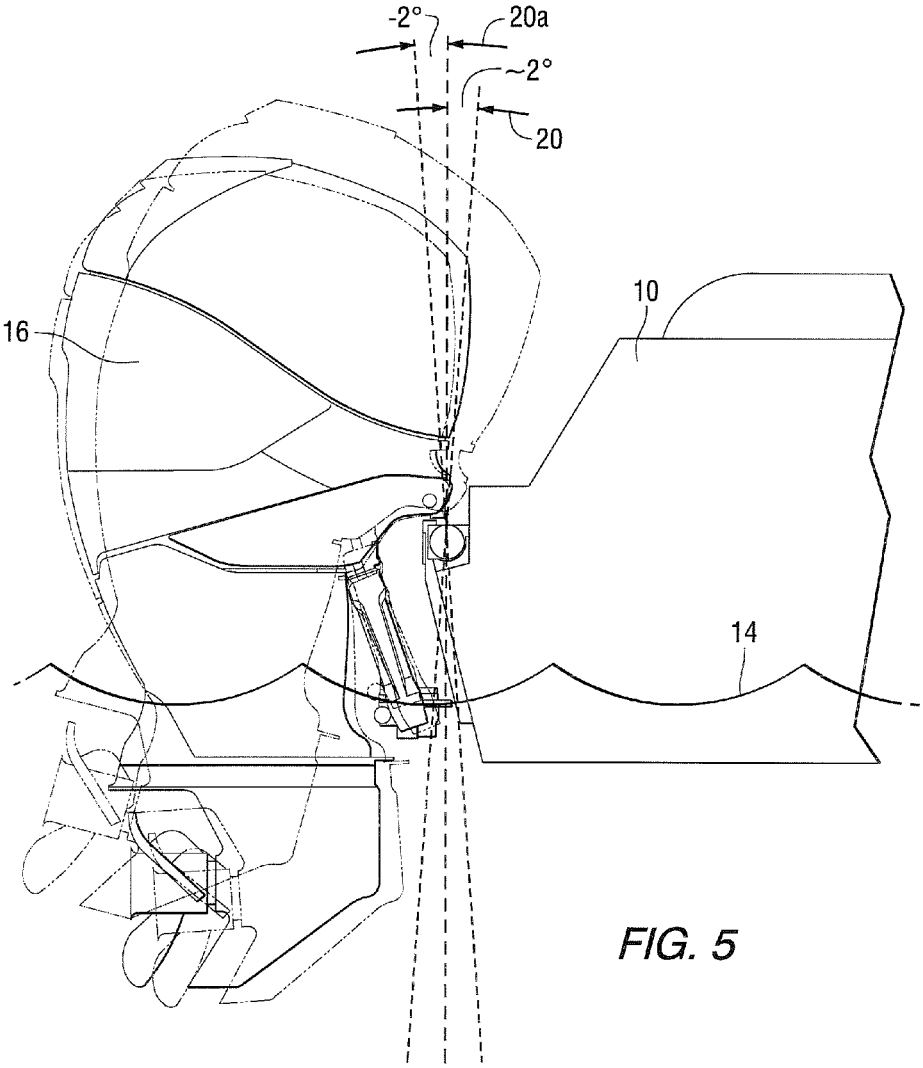
FIG. 5 is an enlarged view showing the conditions of FIGS. 2-4.
Figure 6:
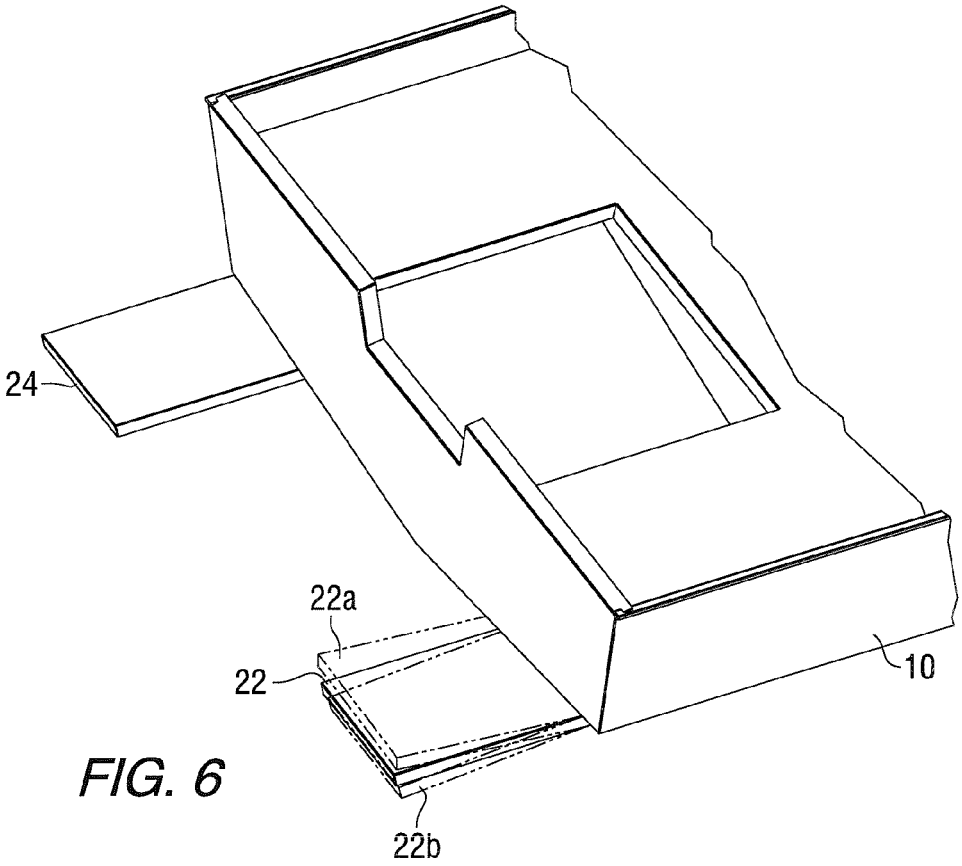
FIG. 6 illustrates adjustment of trim tabs.
Figure 7:
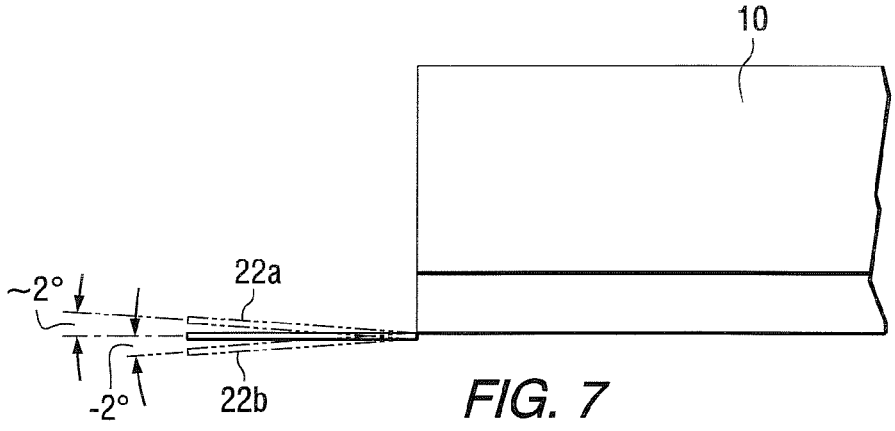
FIG. 7 is a side view of the vessel and trim tabs of FIG. 6.

It is known to correct the noted porpoising condition by decreasing the drive trim angle, e.g. the 2° angle as shown at 20 in FIG. 2 is decreased to 0° as shown in FIG. 3 or perhaps to −2° as shown at 20*a* in FIG. 4. These drive trim angles are also shown in FIG. 5. It is also known to move trim tabs such as 22, 24, FIG. 6, on the vessel, downwardly, e.g. from an upwardly angled position as shown in dashed line at 22*a* to a downwardly angled position as shown in dashed line at 22*b*, and as also shown in FIG. 7.

Figure 8:
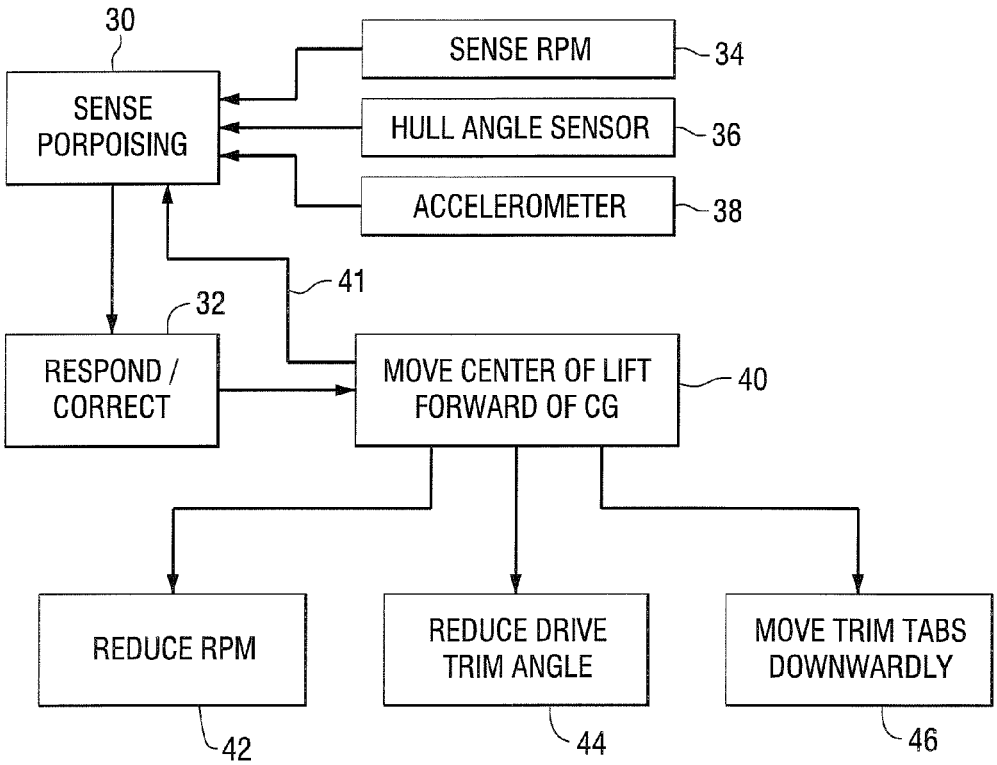
FIG. 8 illustrates a control method.

The present system provides a method for controlling operation of a marine vessel 10 subject to porpoising, including sensing, at 30, FIG. 8, an operational characteristic of the marine vessel which is indicative of porpoising of the vessel, and responding, at 32, to the sensing of the operational characteristic with a response that is representative of the operational characteristic of the marine vessel as being indicative of the noted porpoising of the marine vessel. The operational characteristic may comprise operating speed of the marine engine of drive unit 16 of the vessel, e.g. at 34, e.g. as sensed by a tachometer. Such operational characteristic may comprise a recognizable pattern of a plurality of cyclic changes of the magnitude of the operating speed of the marine engine of drive unit 16. For example, when porpoising occurs, the marine drive engine is typically loaded and unloaded as the bow of the vessel moves into and out of the water. This loading effect causes the engine RPM (revolutions per minute) to fluctuate in a cycling pattern, which pattern can be detected by monitoring the tachometer signal and then applying pattern recognition. The noted operational characteristic may additionally or alternatively comprise the tilt angle of the marine vessel, e.g. a positive tilt angle as shown at 10*a* in FIG. 1, and a negative tilt angle as shown at 10*b*. Such operational characteristic may further comprise a recognizable pattern of a plurality of cyclic changes of the magnitude of the tilt angle 10*a*, 10*b* of marine vessel 10 in comparison to a preselected plane, e.g. plane 14*a* parallel to the surface 14 of the body of water 12. Such operational characteristic may be sensed with a hull angle sensor as at 36. The operational characteristic may additionally or alternatively be sensed with an accelerometer as at 38.

The system responds at 32 to the sensed operational characteristic and in one embodiment automatically corrects porpoising. The system may respond at 40 to the sensing of the operational characteristic by moving the center of lift of the vessel forwardly of the center of gravity of the vessel, with confirmation sent back via feedback loop 41 to provide closed loop control in an active system monitoring porpoising all the time in one embodiment. The system may respond to the sensing of the operational characteristic by changing the tilt angle 10*a*, 10*b* of marine vessel 10. The system may respond to the sensing of the operational characteristic by decreasing the tilt angle, e.g. from 10*a* to 10*b*. The system may respond to sensing of the operational characteristic by changing the operating speed of the marine engine of drive unit 16 of the vessel. The system may respond to the sensing of the operational characteristic by reducing at 42 the operating speed of the marine engine of drive unit 16 of the vessel. The system may respond to the sensing of the operational characteristic by changing the trim angle 20, 20*a* of the marine drive 16 of vessel 10. The system may respond to the sensing of the operational characteristic by reducing the drive trim angle, at 44, e.g. from 20, FIG. 2, to 20*a*, FIG. 4. The system may respond to the sensing of the operational characteristic by moving trim tabs of the vessel 10 if so equipped, e.g. trim tabs 22, 24. The system may respond to the sensing of the operational characteristic by moving trim tabs 22, 24 downwardly, e.g. from position 22*a* to position 22*b*, FIGS. 6, 7. The system may respond to the sensing of the operational characteristic by providing an alarm recognizable by an operator of the marine vessel.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A method for sensing porpoising of a marine vessel driven by a marine drive engine, comprising sensing an operational characteristic of said marine vessel indicative of porpoising comprising sensing a recognizable pattern of a plurality of cyclic changes of operating speed of said marine drive engine, performing said method with a tachometer.

2. The method according to claim 1 comprising sensing loading and unloading of said marine drive engine as the bow of said marine vessel moves into and out of the water causing engine speed to fluctuate in a cycling pattern, and detecting said pattern by monitoring engine speed and then applying pattern recognition thereto.

3. A method for sensing porpoising of a marine vessel driven by a marine drive engine, comprising sensing an operational characteristic of said marine vessel indicative of porpoising comprising sensing a recognizable pattern of a plurality of cyclic changes of tilt angle of said marine vessel, performing said method with a hull angle sensor.

4. The method according to claim 3 comprising sensing loading and unloading of said marine drive engine as the bow of said marine vessel moves into and out of the water in a cycling, pattern, and detecting said pattern by monitoring tilt angle and then applying pattern recognition thereto.

5. A method for sensing porpoising of a marine vessel having sensed accelerometer readings and driven by a marine drive engine comprising sensing an operational characteristic of said marine, vessel indicative of porpoising comprising sensing a recognizable pattern of a plurality of cyclic changes of said accelerometer readings, performing said method with an accelerometer.

6. The method according to claim 5 comprising sensing loading and unloading of said marine drive engine as the bow of said marine vessel moves into and out of the water causing said accelerometer readings to fluctuate in a cycling pattern, and detecting said pattern by monitoring said accelerometer readings and then applying pattern recognition thereto.

* * * * *